United States Patent [19]

Hanaoka et al.

[11] 4,259,026

[45] Mar. 31, 1981

[54] DOT PRINTER HAVING CONCENTRIC DRIVING CAMS

[75] Inventors: Seiji Hanaoka; Masahiko Mori; Takao Kobayashi, all of Shiojiri, Japan

[73] Assignees: Kabushiki Kaisha Suwa Seikosha; Shinshu Seiki Kabushiki Kaisha, both of Tokyo, Japan

[21] Appl. No.: 6,932

[22] Filed: Jan. 25, 1979

[30] Foreign Application Priority Data

Jan. 25, 1978 [JP] Japan ..... 53/6861

[51] Int. Cl.[3] ..... B41J 3/12; B41J 35/10; B41J 19/30; B41J 19/84

[52] U.S. Cl. ..... 400/124; 400/216.1; 400/320; 400/314.1; 400/328; 400/572; 400/185

[58] Field of Search ..... 101/93.05; 400/124, 400/185, 320, 320.1, 322, 328, 314, 314.1, 572, 553, 545, 568, 212, 215, 216.1; 324/174, 208

[56] References Cited

U.S. PATENT DOCUMENTS

| | | | |
|---|---|---|---|
| 1,929,259 | 10/1933 | Rich | 324/174 X |
| 3,885,661 | 5/1975 | Okabe | 400/322 X |
| 3,929,215 | 12/1975 | Hayakawa | 400/328 X |
| 3,986,594 | 10/1976 | Kondur | 400/328 X |
| 4,046,246 | 9/1977 | Kondur | 400/124 X |
| 4,175,876 | 11/1979 | Hanaoka | 400/328 X |

*Primary Examiner*—Paul T. Sewell

*Attorney, Agent, or Firm*—Blum, Kaplan, Friedman, Silberman & Beran

[57] ABSTRACT

In a miniature printer for printing with dots on printing paper, concentrically mounted driving cams provide both horizontal and vertical motions which synchronize the reciprocating action of the printing head mechanism with the paper feed and ink ribbon feed mechanism. Constant velocity linear motion is provided for the print head. The printing paper may be removed in either direction from the printer.

29 Claims, 17 Drawing Figures

DOT PRINTER HAVING CONCENTRIC DRIVING CAMS

BACKGROUND OF THE INVENTION

This invention relates to a printer, and more particularly to a printer wherein the printing head has a reciprocating motion along a printing paper. The printing head includes a plurality of recording needles whereby the characters are formed on the paper by dots.

In printers of the prior art employing a printing head of this type, i.e., using a plurality of recording needles to print by forming dots, the reciprocating motion mechanism for the printing head, the mechanism to start a new line on the recording paper by moving the paper periodically, and the ink ribbon feeding mechanism have been complicated, made up of many parts required to fulfill their functions. For this reason miniaturization of the printers has been prevented. Moreover, the printers of the prior art could not be used in printers of the electronic table calculator type, because the prior art printers are large and expensive.

What is needed is a small, low price printer having a simple structure and a small number of parts, which operates accurately.

SUMMARY OF THE INVENTION

Generally speaking, in accordance with the invention, a printer especially suitable for printing by forming small dots on a printing paper by means of a printing head having a plurality of recording needles, is provided. The miniaturized printer of this invention includes concentrically mounted driving cams providing horizontal and vertical motions which synchronize the reciprocating action of the printing head mechanism with the paper feed and ink ribbon feed mechanisms. Constant velocity linear motion is provided in reciprocating the print head by a cam recessed in a rotating disk. The reverse side of the disk includes elevated cams which control the paper feed and the ink ribbon feed mechanisms.

Accordingly, it is an object of this invention to provide an improved printer which drives the printing head in linear constant speed motion by means of a recessed cam.

Another object of this invention is to provide a printer which synchronizes the motions of the printer head, paper feed and ink ribbon feed mechanisms by means of concentrically operating cams.

A further object of this invention is to provide a printer having a printing head which tracks accurately.

Still another object of this invention is to provide a printer wherein the paper advances smoothly and the ink ribbon advances without impact or sagging.

Yet another object of this invention is to provide a printer which is small in size and inexpensive to fabricate.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
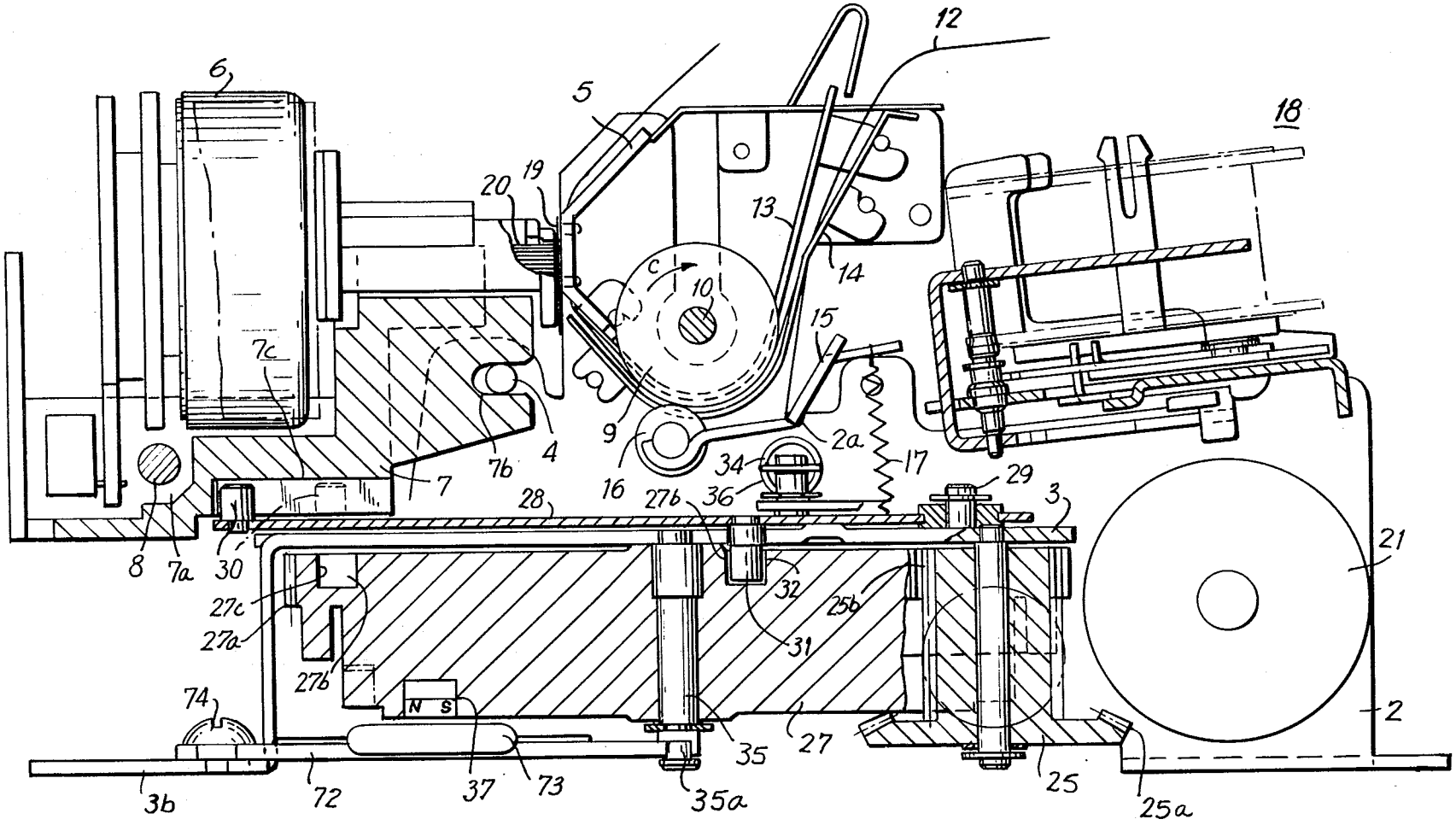
FIG. 1 is a side elevation, partially in section, with parts removed, of the printer of this invention.
Figure 2:
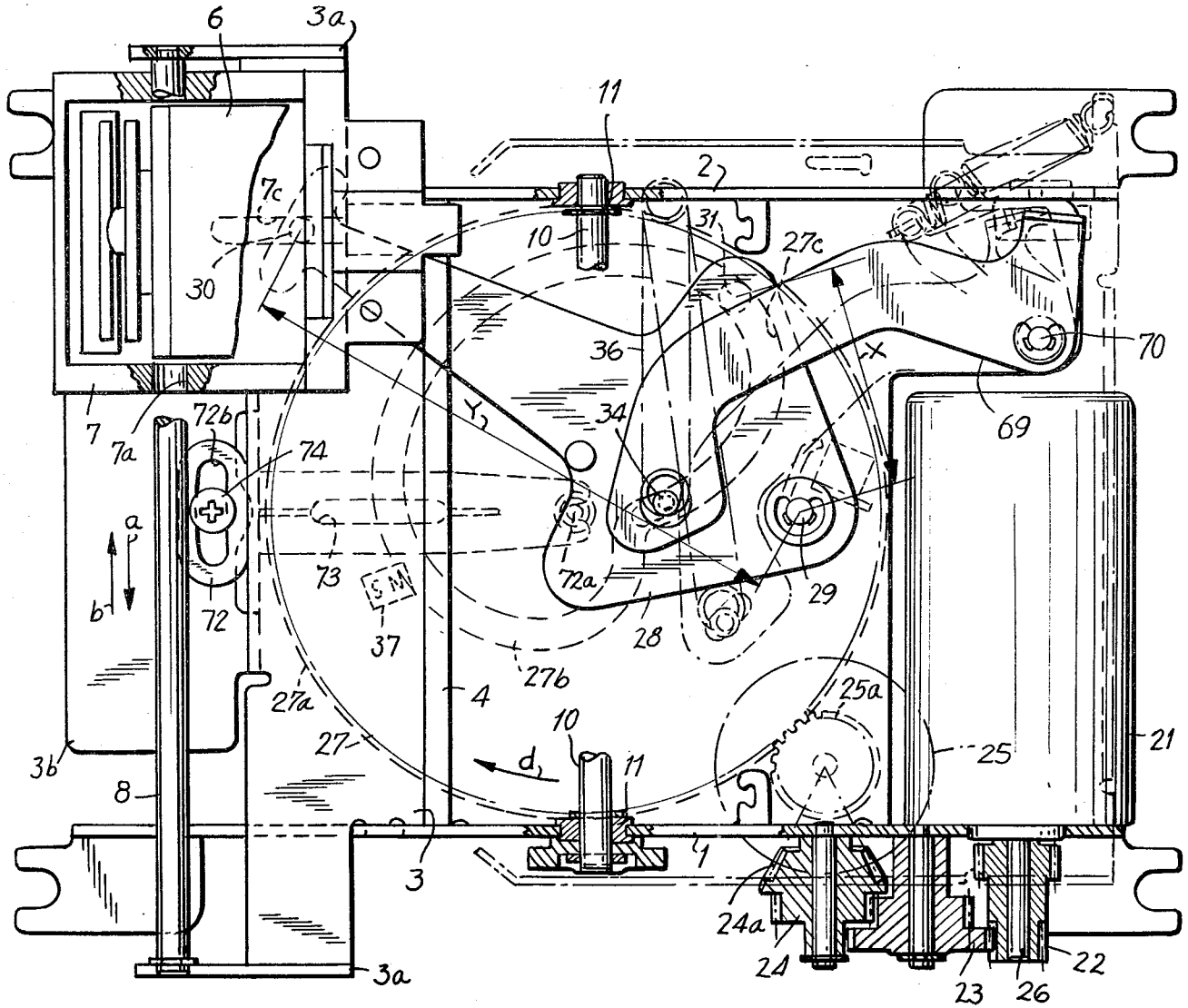
FIG. 2 is a plan view of the printer of FIG. 1.

In FIGS. 1 and 2, the bottom frame 3 is supported between side frames 1, 2 and the frames are fixed to each other to form an H-shape. Moreover, rigidity for this H-shaped structure is secured by fixedly supporting the first guide shaft 4 and the platen 5 between the side frames 1, 2. The head stand 7 is mounted for lateral motion on the second guide shaft 8, said shaft being fixedly supported by a pair of bent-up flanges 3*a* provided integrally at the bottom frame 3. A slot 7*b* in the head stand 7 receives the first guide shaft 4, thus permitting the head stand 7 to translate laterally in the directions indicated in FIG. 2 by the arrows a and b.

The paper feeding roller 9 is made of rubber or the like and is fixedly attached and rotates with the roller shaft 10. The roller shaft 10 is fixedly supported between the side frames 1, 2 and is rotatably supported therein at each end by bearings 11. The recording paper 12 is guided by a pair of paper guides 13, 14 and passes upwardly between the gap made by the platen 5 and the printing head 6. An idler lever 15 is supported by the cut-away portion 2*a* provided in the side frames 1, 2. The idler roller 16 is pressed against the paper feeding roller 9 through the recording paper 12 by means of the idler lever 15 and by the idler spring 17 which acts to bias the idler roller against the paper 12. The ink ribbon 19, held in reels by the ink ribbon device 18, is arranged in the gap made between the printing head 6 and the platen 5, and more particularly the ink ribbon 19 is inserted between the recording paper 12 and the printing head 6.

In a position on the printing head 6 opposing the platen 5, are located a plurality of recording needles 20 arranged perpendicularly to the platen 5. The recording needles 20 are driven in the direction of the platen 5 by electromagnetic means (not shown) so as to collide with the platen 5 through the ink ribbon 19 and the recording paper 12. Thereby dots are printed on the recording paper 12. When the printing head 6 moves rectilinearly at a constant speed in the direction indicated in FIG. 2 by the arrow a, the recording needles 20 are selectively operated by means not shown, to form characters comprised of dots on the recording paper 12. When the printing head 6 moves rectilinearly in the direction as indicated in FIG. 2 by the arrow b, the paper feeding roller 9 rotates by a fixed amount in the direction indicated by the arrow c such that the recording paper 12 is advanced by a distance equal to one printed line.

Figure 3:
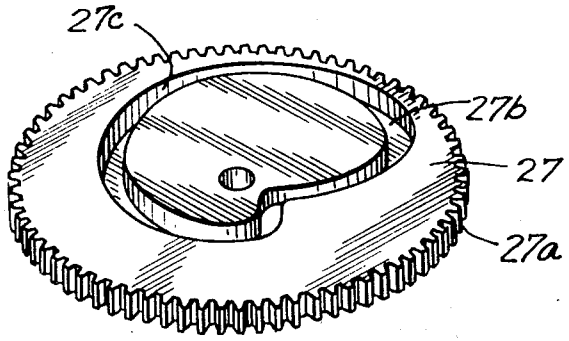
FIG. 3 is a top perspective view of a disk having a cam recessed in its planar surface.

The horizontal disk 27 is rotatably mounted on the shaft 35 provided perpendicularly to the bottom frame 3. Rotation of the motor 21 is transmitted to the second gear wheel 24 through a motor pinion 22 fixed to the motor shaft 26 and via the first gear 23. The beveled gear wheel **24*a* rotates integrally with the second gear wheel 24 on an axis parallel to bottom frame 3. The bevel gear 24*a* engages the bevel gear 25*a* on the third gear wheel 25. The third gear wheel 25 rotates on an axis perpendicular to the bottom frame 3. The spur gear 25*b* integral with the third gear wheel 25 engages with gear teeth 27*a* on the periphery of the rotating disk 27 so that rotation of the motor is transmitted as rotation of the disk 27 in the direction indicated in FIG. 2 by the arrow d. As described more fully hereinafter, the lever 28 reciprocally oscillates around the lever shaft 29 which is fixed to the bottom frame 3. The lever driving pin 31 is fixed to the lower surface of the lever 28 and is fitted with a rotational sleeve 32. The lever driving pin 31 with its sleeve 32 is inserted into a recessed cam 27*b* provided in the upper surface of the rotating disk 27. The recessed cam 27*b* in the rotating disk 27 has an essentially rectangular cross-section of uniform width throughout its length. The recessed cam forms a closed loop as shown in FIG. 3 and one full rotation of the disk 27 in the direction indicated by the arrow d, causes the lever 28 to produce a single oscillation around the lever shaft 29** as a rotational center.

The bottom frame 3 is provided with an aperture (not shown) so that the lever driving pin 31 may perform the oscillatory motion without striking the frame 3. The head driving pin 30 is fixed at the end of the lever 28 and engages in the straight slot **7*c* provided in the head stand 7. Therefore, the oscillation of the lever 28 is transformed into the rectilinear reciprocating motion of the printing head 6 mounted on the head stand 7. The printing head 6 slides on the twin guide shafts 4, 8 and moves in the directions indicated by the arrows a and b in FIG. 2**.

The shape of the recessed cam **27*b* is selected so that when the printing head moves in the direction of arrow a, a linear motion with constant velocity of the printing head 6 is provided except at both ends of the reciprocation which have nothing to do with the actual printing on the paper 12. The printing is performed in the region where there is linear motion of constant velocity of the head. The tension spring 36 extends between the ribbon driving pin 34 attached to the lever 28 and the side frame 2. The lever driving pin 31 is pressed against the outer wall 27*c* of the recessed cam 27*b* through the sleeve 32**.

Taking the tolerance of production into consideration, it is necessary to provide play between the lever driving pin 31, the sleeve 32 and the recessed cam **27*b*. The amount of play of the lever driving pin 31 in the recessed cam 27*b* is magnified at the location of the head driving pin 30 by the ratio of the dimension X to the dimension Y as seen in FIG. 2. Therefore, the lever driving pin 31, provided with the sleeve 32, is pressed against the outer wall 27*c* of the recessed cam 27*b* by the action of the tension spring member 36 during the time the disk 27 rotates. The sleeve 32 rolls along the outer wall 27*c*, thus providing the same conditions as if the play of the lever driving pin 31 in the recessed cam 27*b*** was zero.

If the tension spring 36 were not used to hold the lever driving pin 31 against the recessed cam wall **27*c*, the following undesirable conditions would exist. When the printing head 6 operates to print, moving in the direction of the arrow a, any external vibration applied to the printer is transmitted to the printing head 6. As a result, the sleeve 32 which is normally in contact with the outer wall 27*c* of the recessed cam 27*b*, would come out of contact with the wall and move within the above-mentioned range of play. Also, because the recessed cam 27*c* is designed so that the printing head moves in the direction of arrow a at a constant velocity when the sleeve 32 rolls along the outer wall 27*c*, the normal linear motion with constant velocity cannot be achieved when the sleeve 32 loses contact with the outer wall 27*c***. As a result, the dots constituting printed characters would not be impressed at constant intervals in the horizontal direction. This would cause a deterioration in quality of the printing.

Further, a change of direction is accomplished suddenly when the motion of the printing head 6 in the direction b changes into the printing operation in the direction of the arrow a. The printing head 6 and the head stand 7 oscillate in a damped vibration at about the time when printing is started due to energy stored mainly in elastic portions of the head stand 7 and printing head 6. This vibration would cause the sleeve 32 to repeatedly engage and disengage with the outer wall **27*c* within the above-mentioned range of play between the lever driving pin 31 and the recessed cam 27*b***. The same deleterious effect would result from this internal vibration as from the external vibration discussed above.

The spring 36 has a spring force sufficiently strong to restrain the external vibrations or the damped vibration of the printing head 6 and the head stand 7 which occur at the time when the printing head 6 changes its direction of motion from that indicated by the arrow a to that indicated by the arrow b. Particularly, the spring 36 must provide sufficient force to keep the sleeve 32 in contact with the outer wall **27*c* of the groove cam 27*b* in the printing region when the head 6** moves in the direction of arrow a.

Figure 4:
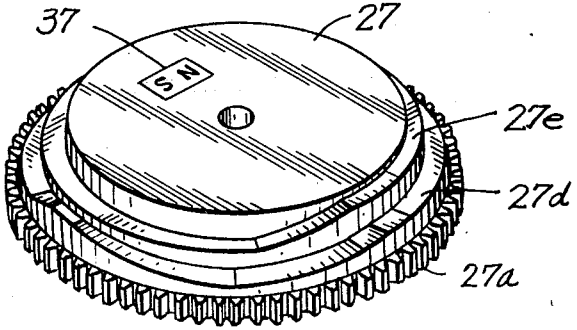
FIG. 4 is a bottom perspective view of the disk of FIG. 3 and including elevated cams raised from the surface thereof.

The disk 27 includes a plurality of cams. The recess cam **27*b*, as described above, opposes the bottom frame 3. On the surface opposite the recess cam 27*b*, as best seen in FIG. 4, are additional cams 27*d* and 27*e*. Whereas cam 27*b* is recessed, cams 27*d* and 27*e* are raised above the surface and provide for vertical displacements of cam following devices as explained hereinafter. The permanent magnet 37 is embedded in disk 27 in a fixed position in relation to the recess cam 27*b***.

Figure 6:
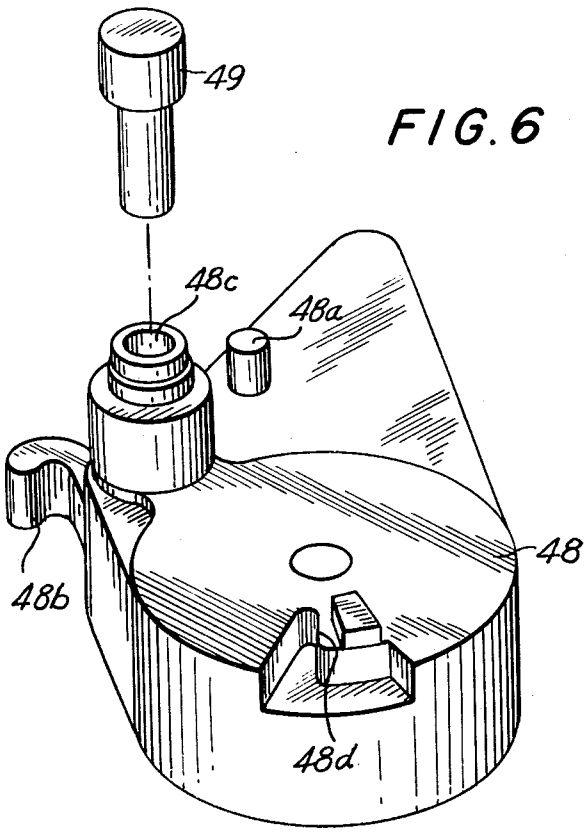
FIG. 6 is an exploded perspective view of a driving member from the mechanism of FIG. 5.
Figure 5:
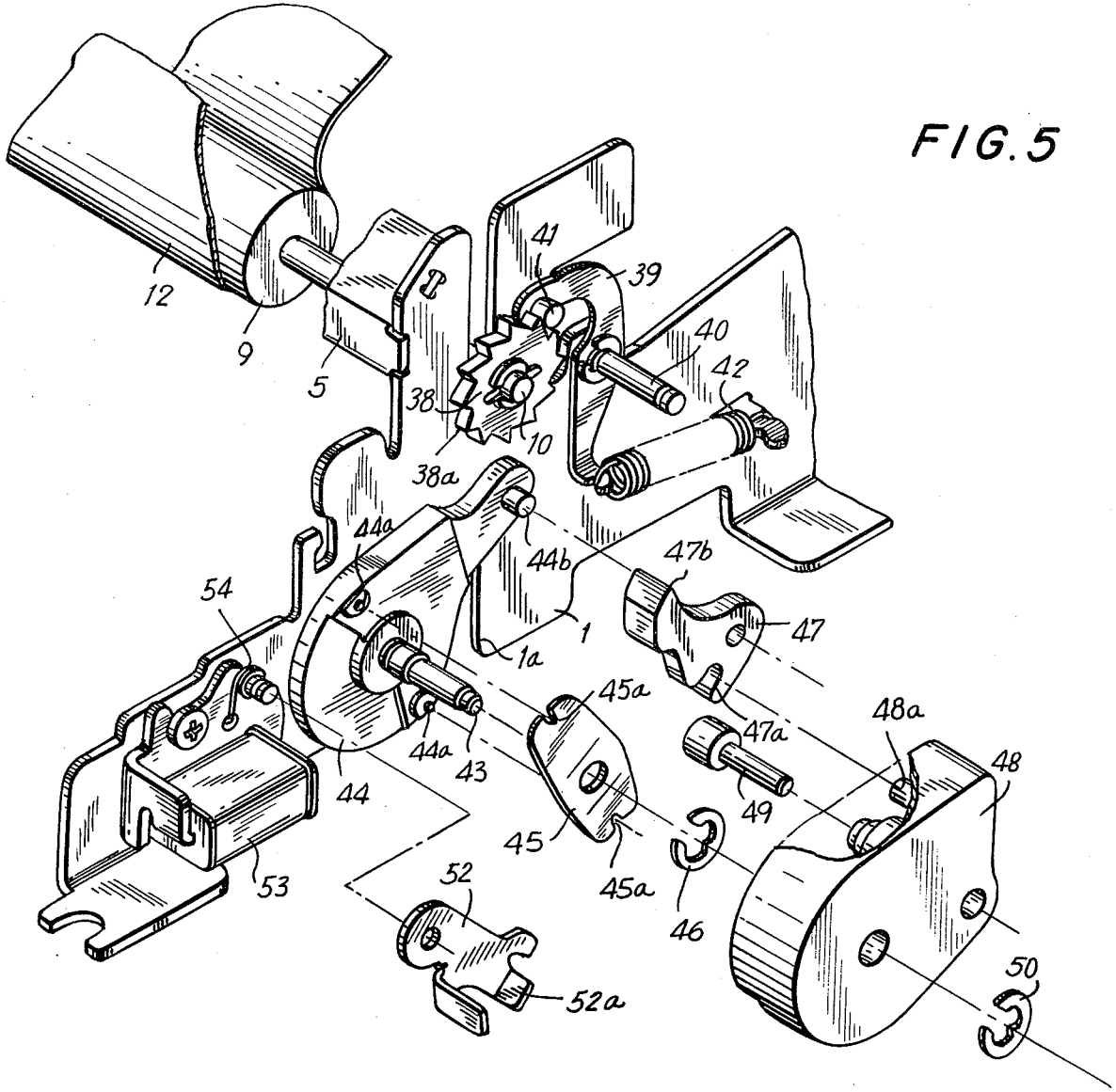
FIG. 5 is an exploded perspective view of the print paper advancing mechanism.
Figure 7:
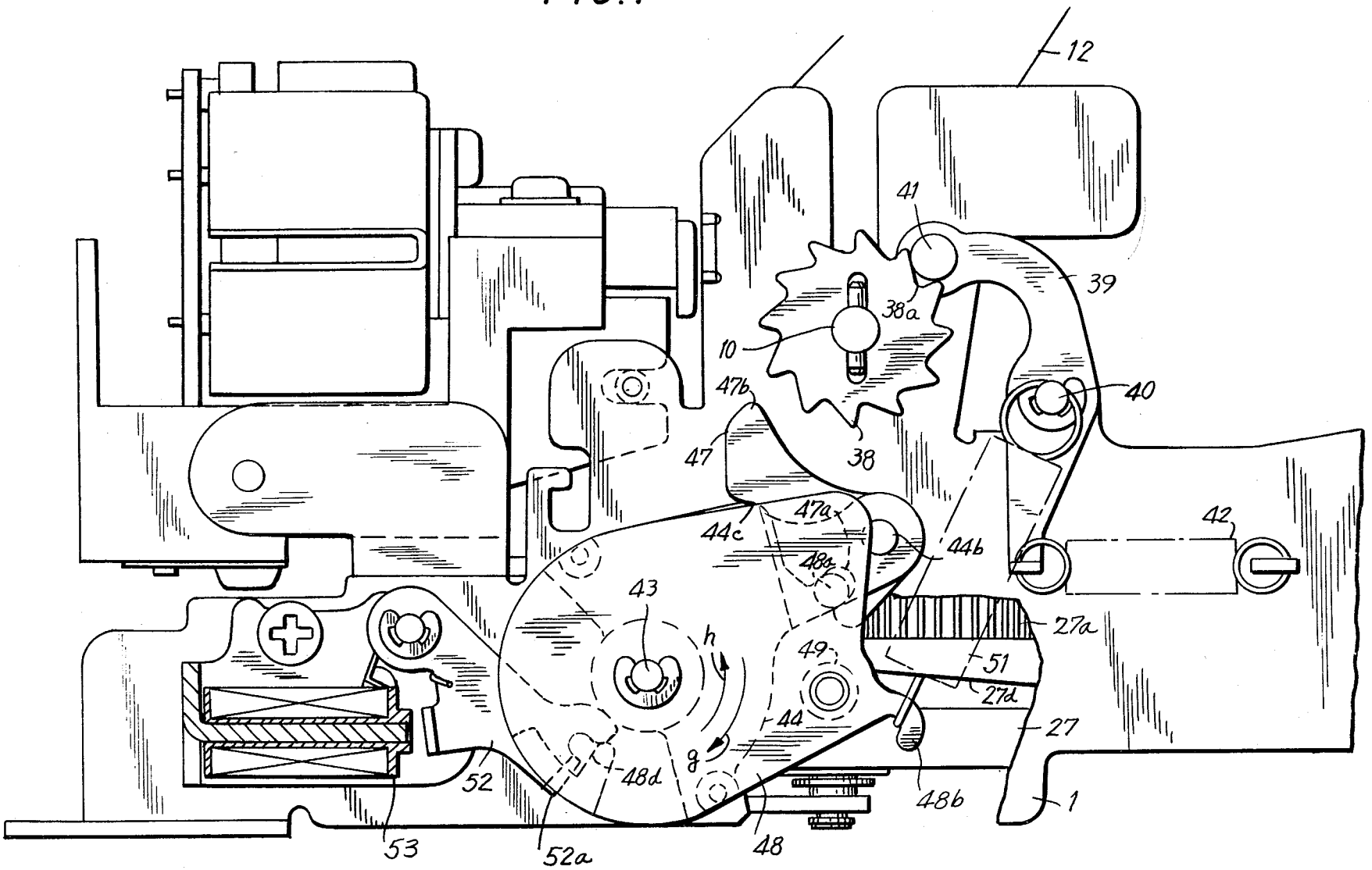
FIGS. 7, 8, 9 and 10 are side elevational views showing the operating sequence for movement of the printing paper.

With reference to FIGS. 5, 6, 7, the roller shaft 10 is fixed to the ratchet wheel 38. The paper feeding roller 9, the roller shaft 10 and the ratchet wheel 38 rotate coincidentally. The detent lever 39 is rotatably mounted on the shaft 40 and the pin 41 fixed to the detent lever 39 engages with the triangular notched section 38*a*, i.e., teeth, provided at equal angles about the circumference of the ratchet wheel 38. The detent spring 42, which is attached to the detent lever 39, gives a counterclockwise turning moment to the detent lever 39. Even when the ratchet wheel 38 is made to rotate by the application of external force, for example, pulling on the recording paper 12, the pin 41 falls into the triangular notched portion 38*a* because of the action of the detent spring 42. This causes the ratchet wheel 38 to always stop at a predetermined position. The position of the shaft 40, that is the rotational center of the detent lever 39, and the shape of the triangular teeth 38*a* of the ratchet wheel 38 are selected so that the ratchet wheel 38 may be rotated forward as well as backward.

The pawl holding member 44 is rotatably mounted on the shaft 43 which extends from the side frame 1. U-shaped notches 45*a*, provided at the ends of a plate spring 45, are fitted to projections, that is, circular bosses 44*a*, provided on the pawl holding member 44. A retaining ring 46 engages with the shaft 43 in such a way that the plate spring 45 is compressed to reduce its thickness. The pawl holding member 44 is pressed against the side frame 1 by the spring force of the plate spring 45, so that when the pawl holding member 44 rotates around the shaft 43, a braking torque is applied to the pawl holding member 44 by its friction with the side frame 1. The pawl shaft 44*b* is integral with the pawl holding member 44, and the pawl 47 is rotatably mounted on the pawl shaft 44*b*. In addition to the pawl holding member 44, the driving member 48 is rotatably mounted on the shaft 43. The retaining ring 50 engages with the shaft 43 and prevents these members from separating.

As best seen in FIG. 6, the driving member 48 includes a cylindrical pawl driving element 48*a* which engages with a U-shaped notch 47*a* in the pawl 47. The roller shaft 49 is rotatably inserted into the hole 48*c*, and the roller shaft 49 rolls on the first raised cam 27*d* (shown in FIG. 4) of the rotating disk 27. The spring 51 (FIG. 7) is attached to the hooked tab 48*b* on the driving member 48 and bridges between the tab 48*b* and the shaft 40. The stop 48*d* on the driving member 48 engages a bent flange 52*a* on the first trigger member 52 (FIG. 5).

With reference to FIGS. 5 and 7, when the driving member 48 is mounted on the shaft 43, a surface of the roller shaft 49 contacts the first raised cam 27*d* (FIG. 4) of the rotating disk 27 through a notch 1*a* provided in the side frame 1. The tension spring 51 bridges between the shaft 40 and the hooked tab 48*b* of the driving member 48, exerts a counterclockwise moment on the driving member 48.

Next the sequence of operations required to feed the recording paper 12 is described with reference to FIGS. 7 through 10.

When the driving member 48 (FIG. 8) rotates in the direction of arrow g due to the travel of the roller shaft 49 on the first raised cam 27*d* of the rotating disk 27, a gap H is produced between the bent flange 52*a* of the first trigger member 52 and the stop 48*d* of the driving member 48. In this condition, when a current flows through the electromagnetic coil 53, the first trigger member 52 rotates in a clockwise direction as viewed in FIG. 8 against the torsion of the return coil spring 54. In this attracted state, as shown in FIG. 9, the bent flange 52*a* of the first trigger member 52 disengages from the stop 48*d*. When the disk 27 starts to rotate, the driving member 48 starts to rotate in the direction of arrow h acted on by the spring 51. The roller shaft 49 moves along the first raised cam 27*d*. In this condition, because of the braking torque produced between the pawl holding member 44 and the side frame 1, the pawl holding member 44 remains at rest, while the pawl driving element 48*a* engages with the U-shaped notch 47*a* of the pawl 47 and causes the pawl 47 to rotate in a clockwise direction as viewed in FIG. 9 around the pawl shaft 44*b* as the driving member 48 rotates in the counterclockwise direction h.

When the driving member 48 rotates in the direction of arrow h (FIG. 9), the pawl holding member 44 remains at rest as stated above, and the pawl driving element 48*a* causes the pawl 47 to rotate around the pawl shaft 44*b* of the pawl holding member 44. The upper end 47*b* of the pawl 47 comes to rest in the triangular notched portion 38*a* between the teeth of the ratchet wheel 38. In this condition, the pawl 47 can no longer rotate around the pawl shaft 44*b*. When the driving member 48 continues to rotate in the direction of arrow h, the pawl holding member 44 rotates around the shaft 43 almost coincidentally with the driving member 48. The pawl holding member 44 is driven by the pawl driving element 48*a* acting through the pawl 47. By this operation, the ratchet wheel 38 is rotated by a fixed amount in the clockwise direction as viewed in FIG. 10, so that the roller shaft 10 and the feeding roller 9 are rotated so that a line change on the recording paper 12 is accomplished. That is, the recording paper 12 is moved so that the next line may be printed.

Figure 10:
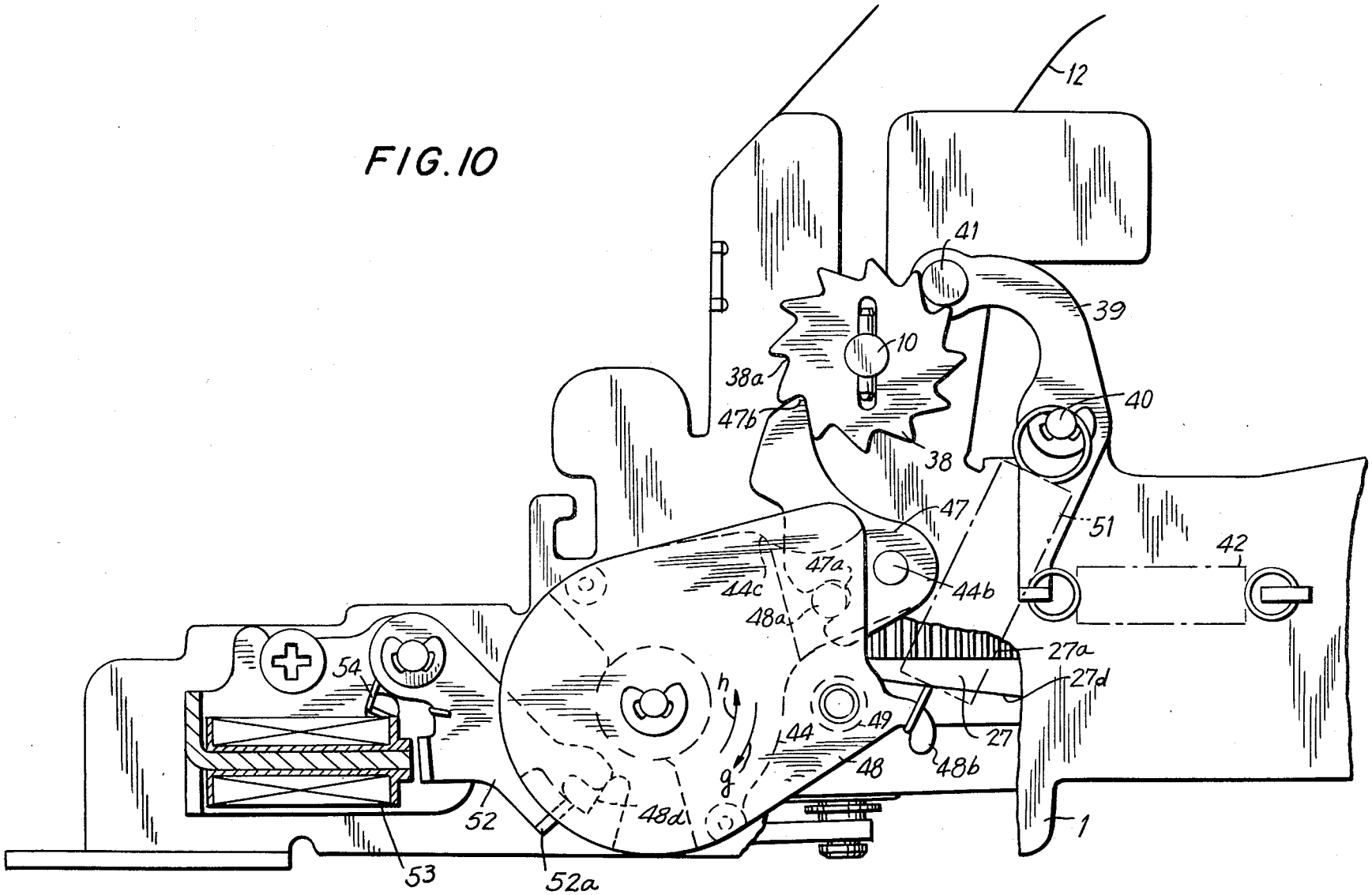

After the driving member 48 rotates in the direction of arrow h to its most extreme position as shown in FIG. 10, continued rotation of the disk 27 causes the driving member 48 to rotate in the direction of the arrow g by means of the roller shaft 49 moving on the surface of the first raised cam 27*b* on the disk 27. At this time, because of the aforesaid braking force produced between the side frame 1 and the pawl holding member 44, the pawl holding member 44 remains at rest. As the driving member 48 continues to rotate, the pawl driving element 48*a* causes the pawl 47 to rotate counterclockwise around the pawl shaft 44*b*.

The pawl 47 (FIG. 7) continues to rotate in a counterclockwise direction until it is brought to rest by the stop 44*c* on the pawl holding member 44. The pawl holding member 44 and the pawl 47 then rotate, through the action of the pawl driving element 48*a*, in the direction of arrow g coincidentally with the driving member 48. Thus, the condition as shown in FIG. 8 is restored.

Figure 8:
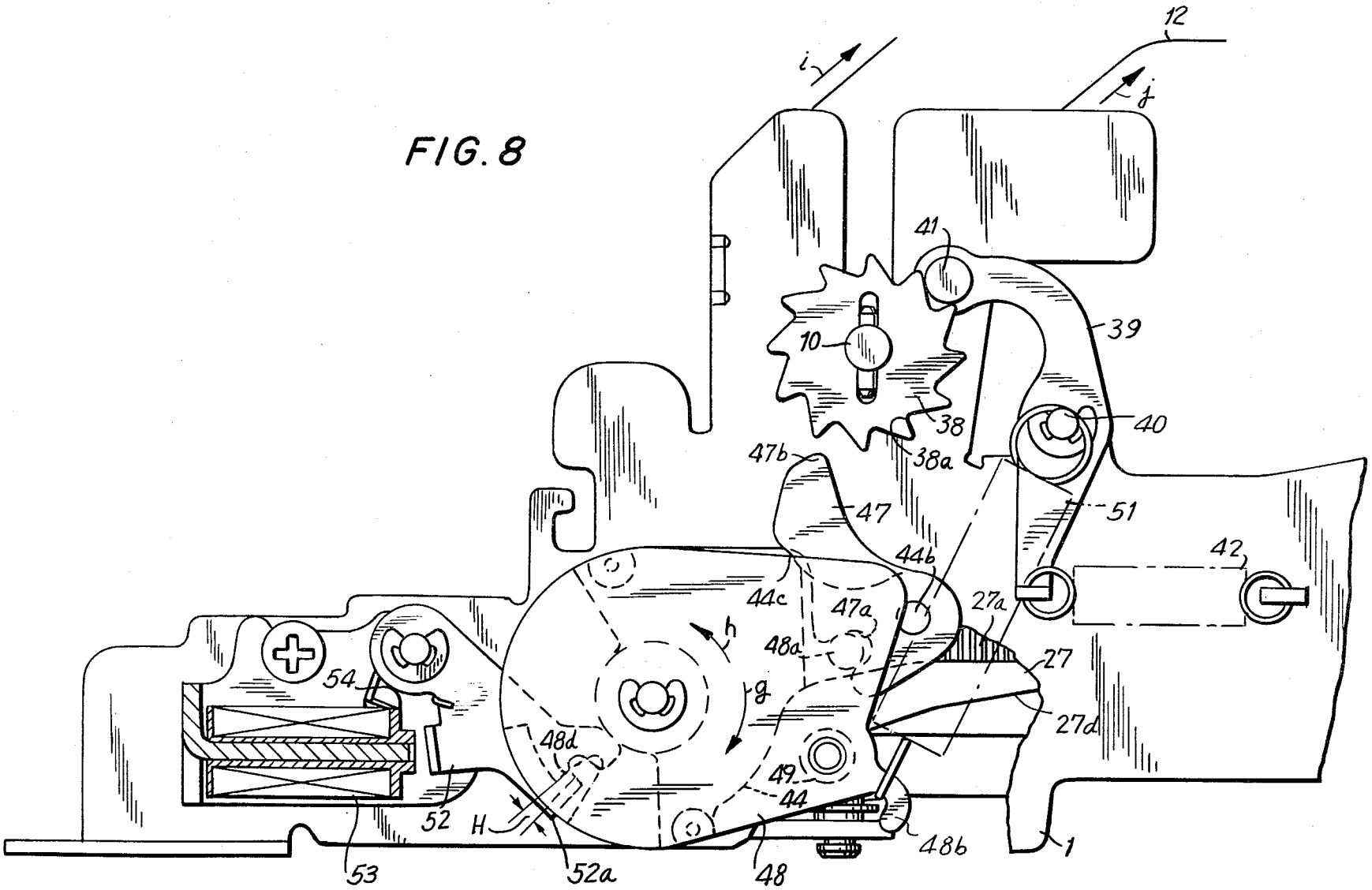
Figure 9:
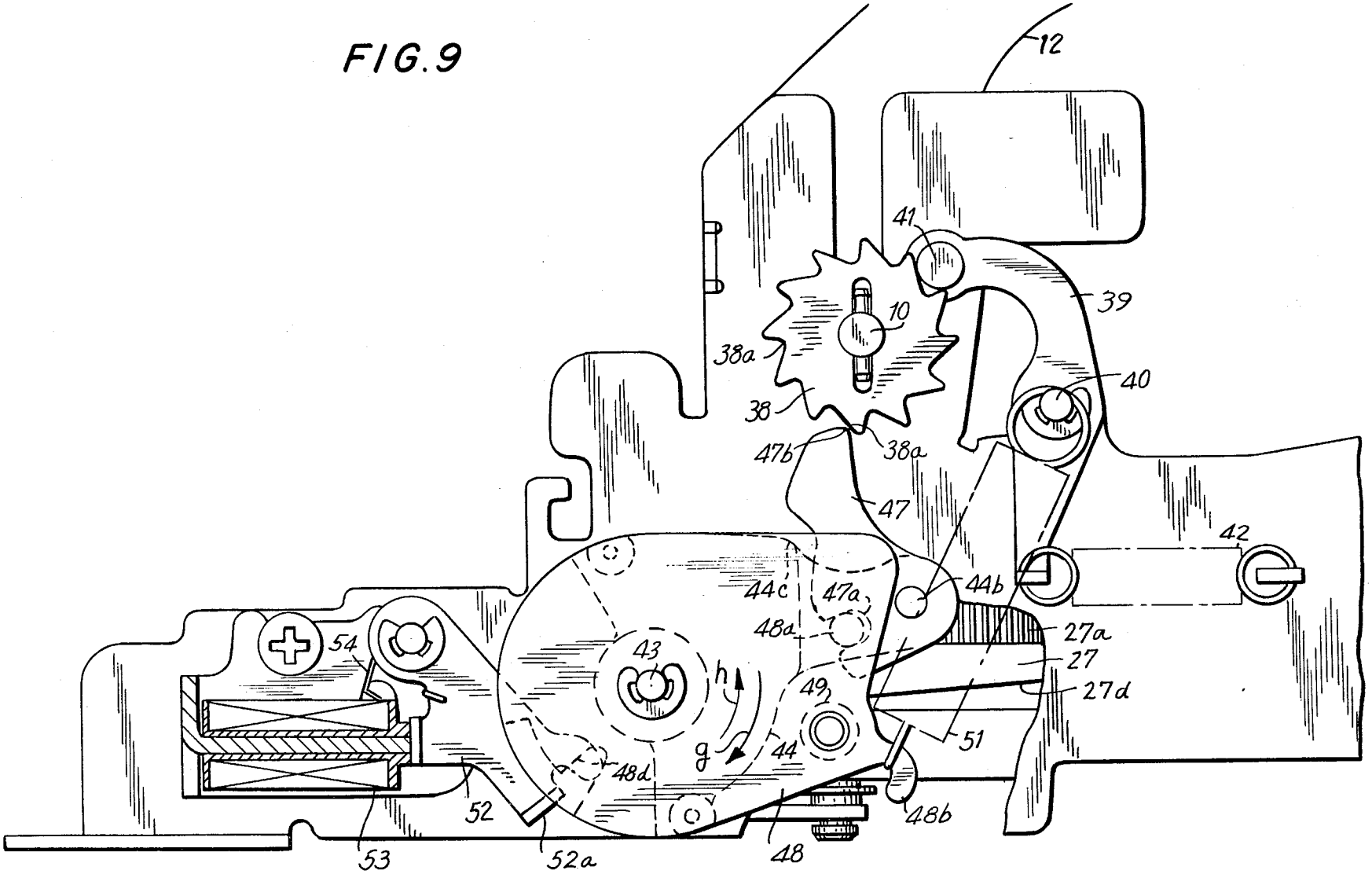

In FIG. 8, the spring 51 spanning between the driving member 48 and the shaft 40, stores energy derived from the first raised cam 27*d* while the driving member 48 rotates in the direction of arrow g, and the spring 51 releases the stored energy when the roller shaft 49 operates along the first raised cam 27*d* and the driving member 48 rotates in the direction of arrow h, and accomplishes a feeding of the recording paper 12.

When the first raised cam 27*d* is provided with a plurality of repetitions of the same cam profile, the recording paper 12 can be quickly fed several times within one printing cycle while the rotating disk 27 rotates fully one time. By selectively operating the first trigger member 52 by means of the electromagnetic coil 53, it is possible to select a feeding method, that is feeding the recording paper 12 only once after printing, or a quick feed of the paper 12 several times while the rotating disk 27 rotates fully once.

In the condition wherein the rotating disk 27 is at rest without printing, and the pawl 47 is not in engagement with the ratchet wheel 38 (FIGS. 7, 8), the ratchet wheel 38 can rotate forward as well as backward and the recording paper 12 can be pulled out by hand in either direction as indicated by arrow i and arrow j. In the prior art when the recording paper is to be pulled out by hand, it is necessary to release the pressure of the idler roller (FIG. 1) against the paper feeding roller because a pawl is always in engagement with the ratchet wheel. The operation to release the pressure on the paper feeding roller is troublesome, moreover, a mechanism to do so had to be incorporated in the printer. However, this invention eliminates these deficiencies, because the pawl 47 is disengaged from the ratchet wheel 38. Additionally, because the mechanism for releasing the engagement of the pawl 47 from the ratchet wheel 38 is very simple, and its operation is also simple, the mechanism has high reliability.

Figure 11:
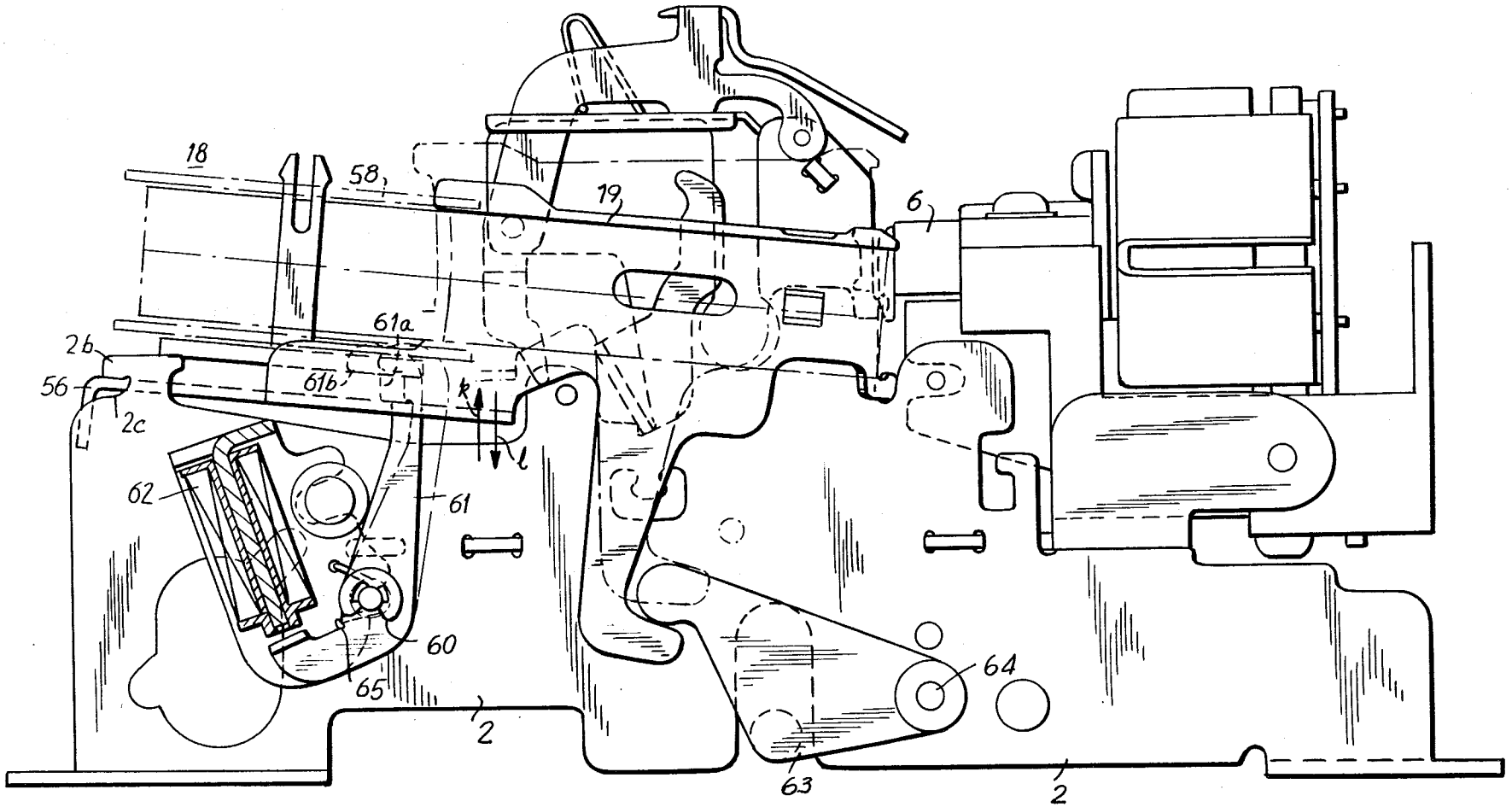
FIG. 11 is a side elevation view of the ink ribbon mechanism in relation to the printing head.
Figure 12:
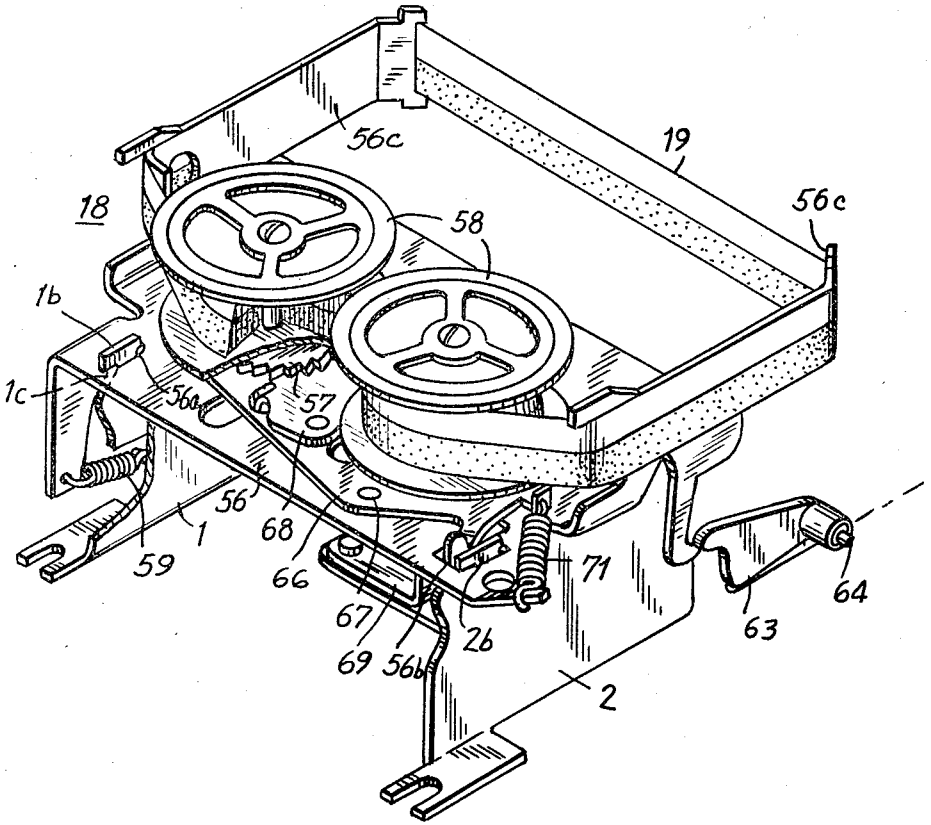
FIG. 12 is top perspective view of the ink ribbon device of FIG. 11.

With reference to FIGS. 11, 12, the latch projection 1*b* of the side frame 1 and the latch projection 2*b* of the side frame 2 are inserted into slots 56*a*, 56*b* respectively, and the ribbon frame 56 of the ink ribbon device 18 is mounted so that it rotates in the directions of arrow k or arrow l using the concave portions 1*c* and 2*c* as rotational centers. A pair of spool wheels 57 are rotatably mounted on the ribbon frame 56, and the ribbon spools 58, on which the ink ribbon 19 is wound, are mounted on the spool wheels 57. The ink ribbon 19 is guided by a pair of arms 56*c* on the ribbon frame 56 and passes in the gap between the platen 5 and the printing head 6 (FIG. 1). The shift spring 59 is suspended between the ribbon frame 56 and the side frame 1 imparting a counter-clockwise moment in the direction of arrow k (FIG. 11) to the ribbon frame 56.

Rotation of the ribbon frame 56 in the direction of arrow k due to the action of shift spring 59, is stopped at the position shown in the solid line in FIG. 11 by means of the first rest element 61*a* on the second rest member 61 which is rotatably supported on the shaft 60. The ink ribbon 19 is in two colors limited to the upper and lower sides respectively thereof. At the positions shown (FIG. 11) by the solid line, the upper color is printed by the printing head 6. When current flows through the shift electromagnetic coil 62, the second rest member 61 is attracted to the positions shown by the two-point broken line, and the ribbon frame 56 rotates in the direction of arrow k by means of the shift spring 59. The ribbon frame 56 is brought to rest at the position shown by the two-point broken line by the second rest portion 61*b* of the second rest member 61. At the position of the ribbon frame 56 shown by the two-point broken line, the lower color is printed by the printing head 6.

The reset member 63 is rotatably mounted on the shaft 64, and the shaft 63*a* integral with the reset member 63 operates with a reciprocating motion by travelling along the second raised cam 27*e* (FIG. 4) on the rotating disk 27. When the lower color of the ink ribbon 19 is to be printed, the current is turned on to flow through the shift electromagnetic coil 62 to release the ribbon frame 56 from engagement with the first rest portion 61*a* of the second rest member 61. As the reset member 63 is engaged with the ribbon frame 56, the ribbon frame 56 rotates in the direction of arrow k, being controlled by the second raised cam 27*e*, until the second rest portion 61*b* of the second rest member 61 engages the ribbon frame 56. Thus, print characters are printed by the printing head 6 in the color on the lower portion of the ink ribbon 19 when the ribbon frame 56 is in the position shown by the two-point broken line in FIG. 11. After printing, the reset member 63 pushes down the ribbon frame 56, following the second raised cam 27*e*, in the direction of arrow 1 against the force of the shift spring 59. If the ribbon frame 56 is pressed lower than the position shown by the solid line in the direction of arrow 1 more or less, the first rest portion 61*a* is re-engaged with the ribbon frame 56 by the spring force of the return coil spring 65 attached to the second rest member 61.

Figure 14:
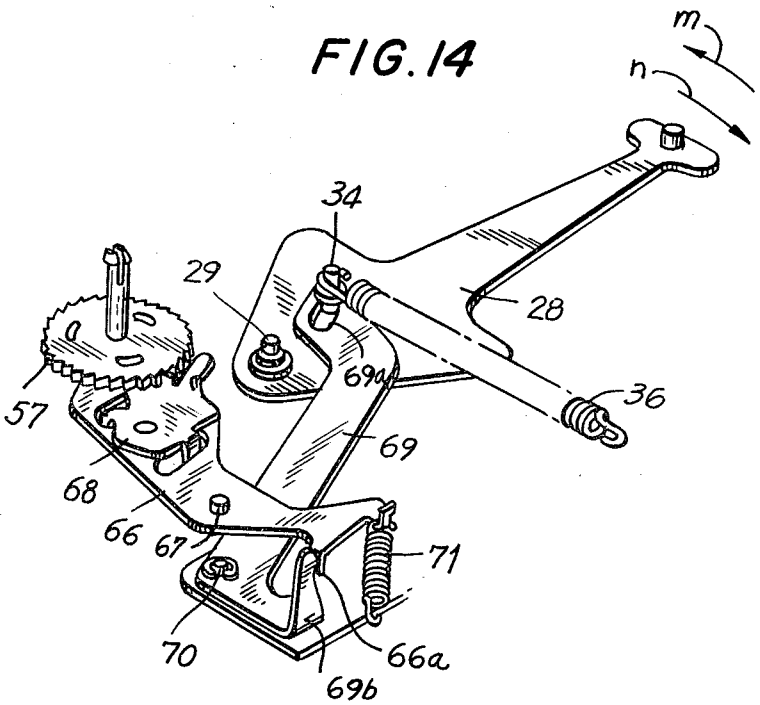
FIG. 14 is a perspective view of the driving means for the ink ribbon device of FIG. 12.
Figure 13:
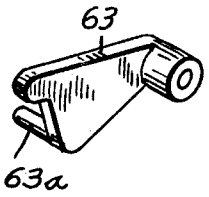
FIG. 13 is a perspective view of a reset member for the ink ribbon device of FIG. 12.

When the pawl driving member 66 (FIGS. 12, 14), on which the pawl member 68 is mounted reciprocatingly, moves around the axis 67, the spool gear wheel 57 rotates and the ink ribbon 19 is wound around the ribbon spool 58, whereby the ink ribbon 19 is fed. The ribbon driving member 69 is mounted rotatably on the axis 70, and the ribbon driving pin 34, fixed on the lever 28, is engaged with a slot 69*a* in the ribbon driving member 69. The bent tab 69*b* of the ribbon driving member 69 is in contact with the bent tab 66*a* of the pawl driving member 66. When the lever 28 rotates in the direction of arrow m (FIG. 14), the ribbon driving member 69, engaged with the lever 28 by the pin 34, rotates counterclockwise, whereby the pawl driving member 66 is also rotated counterclockwise against the ribbon feed spring 71. When the lever 28 rotates in the direction of arrow n, the pawl driving member 66 is moved to wind up the ink ribbon 19 by means of the energy stored in the ribbon feeding spring 71. The clockwise rotation of the pawl driving member 66 depends on the rotation of the lever 28 via the ribbon driving member 69. Because the shaft 67, which is the rotational center of the pawl driving member 66, is disposed coaxially with the shaft 70, which is the rotational center of the ribbon driving member 69, there is very little relative motion for slippage at the point of contact of the tabs 66*a*, 69*b*. Although the contact stress at the point of engagement of these tabs 68*a*, 69*b* is large because the force exerted by the ribbon feeding spring 71 is relatively large, little relative motion occurs, thereby abrasion is reduced to a minimum. The energy for feeding the ink ribbon 19 is stored in the ribbon feeding spring 71 by rotating the lever 28 in the direction of the arrow m, as described above. A relatively large angle of rotation is used during each rotation of the rotating disk 27 in order to stretch the ribbon feeding spring 71, whereby the workload is distributed to the motor 21 over an extended period of time rather than in a peak loading. When the ink ribbon 19 is fed by the clockwise rotation of the pawl driving member 66, the movement of the pawl driving member 66 is controlled by the rotation of the lever 28 in the direction of the arrow n via the ribbon driving member 69, such that the ink ribbon 19 is advanced (fed) without either a shock to the ribbon or a sag in the ribbon 19.

As best seen in FIGS. 1 and 2, the reed switch 73 is soldered on the base plate 72, and the U-shaped slot 72*a* in the base plate 72 is set in the groove 35*a* on the disk shaft 35. The other end of the base plate 72 is fixed on an L-shaped extension 3*b* of the bottom frame 3 by means of the set screw 74. Set screw 74 passes through the arched slot 72*b* at the end of the base plate 72 and allows for angular adjustment of the position of the reed switch 73. The reed switch 73 is turned ON when the permanent magnet 37 provided in the rotating disk 27 comes near the reed switch 73. The reed switch 73 is turned ON and OFF by one rotation of the disk 27. These ON/OFF signals are used for detecting the position of the printing head 6. When the rotating disk 27 is set at the position for the start of printing in the printing range where the head 6 moves in the direction of arrow a, the reed switch 73 is at a position near the permanent magnet 37 in the disk 27 (FIG. 4). At this position of the disk 27, the base plate 72 is pivoted about the disk shaft 35 and fixed by means of the screw 74 at the position where the reed switch 73 is turned ON. Because the reed switch 73 is disposed in alignment with a radius of the rotating disk 27, variations in the position where the permanent magnet 37 comes near the reed switch 73 by rotation of the disk 27 is small. As a result, the angular position of disk 27 where the reed switch turns ON is accurately repeated. Additionally, the reed switch 73 is adjusted by rotating the disk 27 around the disk shaft 35, so the adjustment of the relative position between the disk 27 and the reed switch 73 is easily and accurately performed. Accordingly, operation of electronic circuitry (not shown) is synchronized to the position of the printing head 6 and the disk 27 with its three cams.

Figure 15:
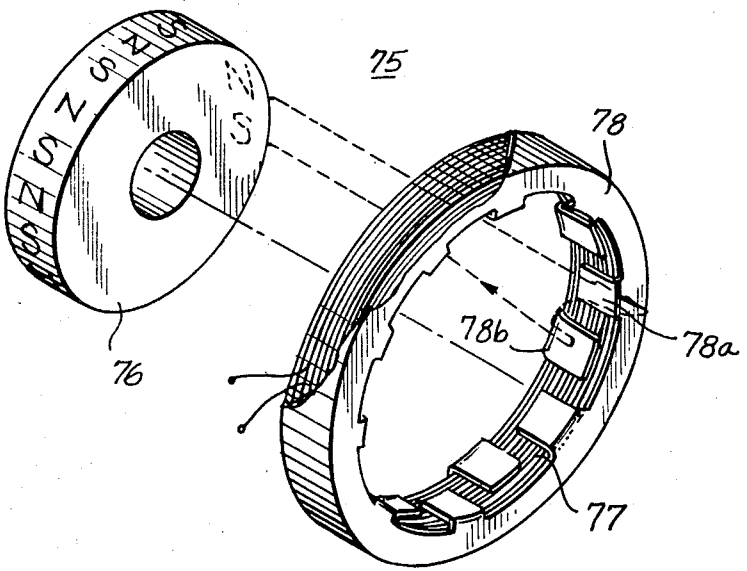
FIG. 15 is a perspective view of a position detecting and timing means.

The timing detector 75 (FIG. 15) is assembled in the motor 21. The rotor 76 is securely fixed to the motor shaft 26 and rotates therewith. The rotor 76 is a permanent magnet, magnetized to provide a plurality of alternate north and south poles around the periphery of the rotor 76. The rotor 76 fits concentrically within the yoke 78 which contains a detecting coil 77 opposed to the external periphery of the permanent magnet rotor 76. On the yoke 78, comb-toothed segments 78*a*, 78*b*, as many as the number of poles on the permanent magnet rotor 76, are disposed one after the other, that is, a segment 78*a* alternates with a segment 78*b* around the inner circumference of the yoke 78. The magnetic flux from the N-poles enters into the comb-toothed segments 78*a* and passes through the comb-toothed segments 78*b* via the yoke 78, and then returns to the S-poles of the rotor 76 as shown by the dotted line and arrows in FIG. 15. Accordingly, this magnetic flux forms closed loops around the detecting coil 77. Since the density of the magnetic flux varies when the permanent magnet rotor 76 rotates, the voltage induced in the detecting coil 77 has a wave form which is almost sinusoidal. For one full rotation of the permanent magnet rotor 76, half as many sinusoidal waves of voltage are induced as the number of poles, that is each N/S pair produces a sinusoidal wave form.

Figure 16:
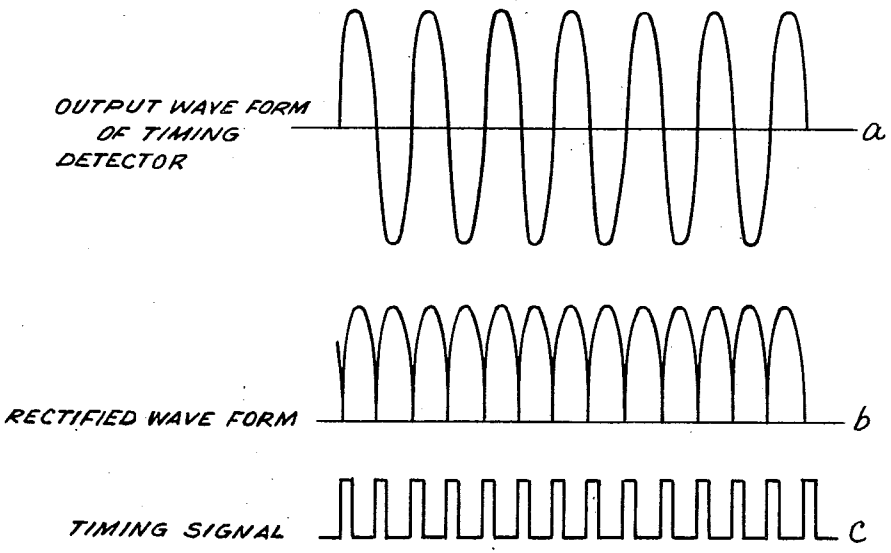
FIG. 16 illustrates the output wave forms from the detecting and timing means of FIG. 15.
Figure 17:
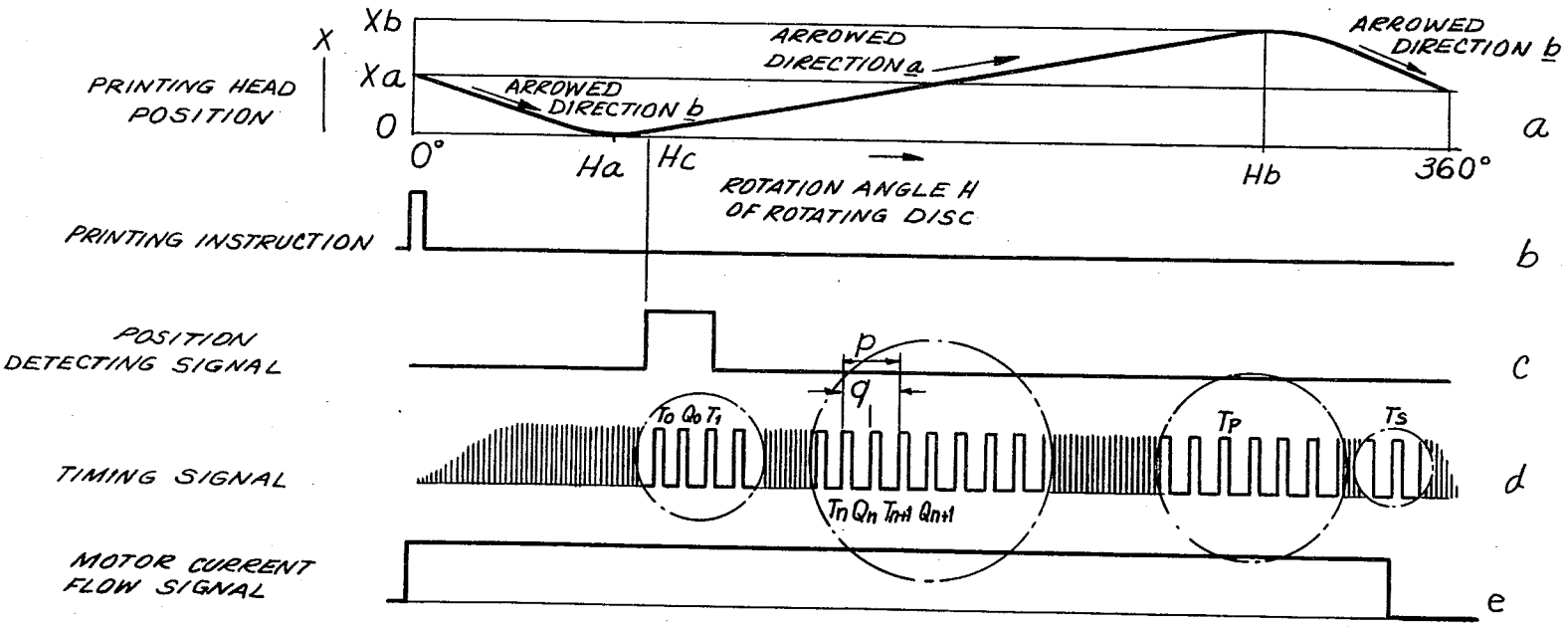
FIG. 17 is a timing chart showing operation of the printer of FIG. 1.

The wave form is illustrated in curve a of FIG. 16. Using well-known circuitry (not shown), the sinusoidal wave forms of curve a have the negative portions inverted to produce the rectified wave form of curve b. The rectified wave form is used to produce square wave timing pulses as shown in curve c of FIG. 16. By inverting the negative portions of the sinusoidal wave forms, the number of timing signals which are produced in one rotation of the permanent magnet rotor 76 equals the number of magnetized poles on the rotor 76. The letter X in the ordinate of the upper curve a of FIG. 17 is used to designate the position of the orinting head 6. The starting point for the movment of the printing head 6 in the direction of arrow a (FIG. 2) is zero on the upper chart a of FIG. 17. When the printer of this invention is not driven, the printing head 6 is disposed almost in the center of its travel range, at Xa, and the rotation angle H of the disk 27 is defined as zero at this time.

When a printing signal (curve b, FIG. 17) is provided to the printer control circuit (not shown), the signal (curve e, FIG. 17) for energizing the motor is provided, whereby the current to the motor 21 is turned ON. The rotational energy of the motor 21 is transmitted to the disk 27 which is rotated in the direction of arrow d, (FIG. 2). The printing head 6 moves linearly from the position Xa in the direction of arrow b in accordance with the movement of the lever 28 responding to the rotation of the disk 27. When the rotation angle of the disk 27 is at the value Ha, the movement of the printing head 6 changes from the direction of arrow b to the direction of arrow a. Because the motor 21 rotates a fixed number of revolutions before the rotation angle of the disk 27 reaches Ha, the sinusoidal wave obtained from the detecting coil 77 has reached a full voltage level and the timing signals (curve d, FIG. 17) are obtained. The printing head 6 moves linearly in the direction of arrow a with constant velocity except at the travel end positions designated as 0 and Xb. During this period of linear motion with constant velocity, the printing operation is performed by the head 6. The relative position of the reed switch 73 and the permanent magnet 37 fixed on the rotating disk 27, is so arranged that a position detecting signal is produced when the printing head 6 starts to move in the direction of arrow a with constant velocity, that is to say when the rotation angle of the disk 27 becomes Hc. The position detecting signal is shown in curve c, FIG. 17.

The printing head 6 moves by a one-dot spacing in response to one step of the motor 21. The timing signal produced immediately after the leading edge of the position detecting signal is represented as $T_o$. Counting is successive, and the timing signal and the position X of the printing head 6 are maintained in correspondence.

During the printing operation when the rotation angle H of the disk 27 is substantially from Ha to Hb, the time for printing one dot by the printing head 6 corresponds to the interval indicated as p of timing signal $T_n$ to $T_{n+1}$, and is equal to double the unit pulse interval q. So the number of poles provided by the permanent magnet rotor 76 is selected to produce a timing signal which bisects the printing time of one dot by the printing head 6. When it is necessary to print a dot at the time $T_n$, a current is provided to electromagnetic means (not shown) on the printing head 6 for a unit pulse time interval q, that is, from time $T_n$ to $Q_n$. At this time, the timing signal $Q_n$ is produced so as to bisect the interval from $T_n$ to $T_{n+1}$. However, it is also possible to divide equally the interval p into any even number of segments. Similarly, current flow may be provided to the printing head 6 for a time period equal to the unit pulse interval q, but it is also possible to provide current flow for any number of pulse intervals q. Moreover, the timing signal produced immediately after the leading edge of the position detecting signal was represented as $T_o$, but it is possible to define the timing signal after counting any arbitrary number of pulses prior to $T_o$.

When a timing signal dividing the interval from $T_n$ to $T_{n+1}$ is not utilized, it is necessary to control the duration of current flow to the printing head by a circuit (not shown), such as a single stable multivibrator utilizing $T_n$ as a standard. In such situations where the duration of current flow increases, the stability of actuation decreases.

When the current to motor 21 is turned OFF, the motor 21 will continue to rotate for a short period of time thereafter. Taking into consideration the number of these revolutions, the current flow signal of the motor (curve e, FIG. 17) is turned off by a timing signal $T_s$ such that the printing head 6 comes to rest at its initial position Xa.

The timing and duration of current flow to the electromagnetic coil 53 (FIG. 7) and to the shift electromagnet 62 (FIG. 11) are also controlled utilizing an arbitrary timing signal $T_p$ as the reference.

In summary, there are many advantageous structural features in the printer according to this invention. The rotating disk 27 is disposed on one side of the bottom frame 3 of the H-shaped frame and the lever 28 is disposed on the other side of the bottom frame 3. If the rotating disk 27 and the lever 28 were to be disposed on the same side of the bottom frame 3, it would not be possible for the lever shaft 29, which is the rotational center for the lever 28, to be located within the diameter of the rotating disk 27 rather than outside of the diameter of disk 27. If the lever shaft 29 is disposed beyond the outside diameter of the rotating disk 27, the following difficulty arises. When the distance for the reciprocating motion of the printing head 6 and the lead of the recessed cam **27*b* are fixed, the angle of rotation of the lever 28 is smaller than in the case illustrated in FIG. 2, whereby the length of the lever 28, that is, the Y dimension, increases. As a result, the printing head 6 would move to the left as seen in FIG. 2**, so the entire length of the printer is enlarged.

Another structural feature is that the first raised cam **27*d* for paper feeding is also provided on the rotating disk 27, whereby movement of the cam surface perpendicular to the axis of rotation of the paper feeding roller 9 is easily transmitted to the driving member 48. Another structural feature exists in that the ribbon frame 56 can easily be pivoted for printing of two color inks by use of the fewest number of parts when the second raised cam 27*e* on the disk 27 is used. Also by transmitting the rotational motion of the lever 28 to the ink ribbon driving member 69**, the ink ribbon device is driven by the fewest number of parts.

The fact that all the motions which are fundamentally necessary for the operation of the printer of this invention are readily taken from the movement of one rotating disk 27, is another structural advantage. Moreover, it is an advantage that the recording paper 12 can be freely pulled out in any direction from the printer by disengagement of the pawl 47 in the paper feeding mechanism. Thus, it is possible to provide a small-sized printer which operates accurately and is comprised of a few parts.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer for printing sequential lines of characters on recording paper, comprising:

a frame;

a printing head mounted to said frame for reciprocating motion relative to said recording paper;

first driving means for reciprocating said printing head, said first driving means including a first cam and follower whereby the velocity and position of said printing head is regulated;

an elongated ink ribbon, said ink ribbon being interposed between said printing head and said recording paper;

means for moving said ink ribbon transversely to the reciprocating motion of said printing head, said means for moving said ink ribbon transversely includes a second cam and follower;

means for incrementally feeding said recording paper to said printing head for printing, said means for feeding including a third cam and follower, said first and second and third cams turning in unison about a common axis, whereby said paper feeding and ink ribbon moving are sychronized to a particular position of said reciprocating printing head.

2. The printer of claim 1, wherein said first cam and follower produce motion transverse to said common turning axis and said second cam and follower and said third cam and follower produce motion parallel to said common turning axis.

3. The printer of claim 1, and further comprising a motor, said motor causing said first cam to rotate, and a lever, said lever movingly connected to said printing head at one end and pivotably mounted to said frame at the other end, said first cam follower connected to said lever between said opposed ends whereby said lever oscillates and said printing head reciprocates when said motor is energized.

4. The printer of claim 3, wherein said first cam is on one side of a frame member and said oscillating lever is on the other side of said frame member, said first cam follower extending through said frame member for attachment to said lever and contacting engagement with said cam.

5. The printer of claim 4, wherein said first cam is a disk having the cam profile recessed into one surface of said disk and the second cam profile and third cam profile are raised from said disk.

6. The printer of claim 3, wherein said means for intermittently feeding said recording paper to said printing head for printing further includes:

a rotatable roller about which said paper is threaded, rotation of said roller causing said paper to be fed, said roller being mounted on a first shaft;

a ratchet wheel mounted for rotation with said first shaft;

a pawl, said pawl being engaged to said ratchet wheel for feeding of said recording paper;

a pawl holding member, said pawl holding member being rotatably mounted on a second shaft extending from said frame, said pawl being rotatably pivoted on said pawl holding member;

a pawl driving member, said pawl driving member being rotatably mounted on said second shaft, said pawl driving member including a pawl driving element which engages with said pawl and the roller shaft rolls on said third cam, whereby rotation of said third cam by said motor causes said pawl to intermittently rotate said ratchet wheel and said roller.

7. The printer of claim 6 wherein when said roller is at standby and not driven to feed said paper, said pawl is disengaged from said ratchet wheel and said paper may be pulled from said roller in either direction.

8. The printer of claim 4, wherein said frame is H-shaped and said frame member is the cross-bar between two side frame members.

9. The printer of claim 1, wherein said three cams are incorporated on a single disk.

10. The printer of claim 9, wherein said single disk has said first cam recessed into one face of said disk and said second and third cams are raised from the opposite face of said disk.

11. The printer of claim 10, and further comprising means for advancement of said ink ribbon parallel to the reciprocating motion of said printing head.

12. The printer of claim 11 wherein said means for advancement of said ink ribbon includes said lever for reciprocating said print head whereby synchronization between said reciprocating print head and the advancement of said ink ribbon is provided.

13. The printer of claim 1 wherein said means for transversely moving said ink ribbon is driven in part by said second cam follower operating on said second cam, and further including stopping means for preventing the transverse motion of said ink ribbon, said stopping means being controlled by the actuation of an electromagnetic coil.

14. A printer for printing sequential lines of characters on recording paper, comprising:

a frame, a printing head mounted to said frame for reciprocating motion relative to said recording paper;

first driving means for reciprocating said printing head, said first driving means including a first cam and follower whereby the velocity and position of said printing head is regulated;

an elongated ink ribbon, said ink ribbon being interposed between said printing head and said recording paper;

means for moving said ink ribbon transversely to the reciprocating motion of said printing head, said ink ribbon being divided into two portions, said means for transversely moving said ink ribbon including a second cam and follower, said first and second cams turning in unison about a common axis;

a motor, said motor causing said first cam to rotate;

a lever, said lever movingly connected to said printing head at one end, pivotably mounted to said frame at the other end, said first cam follower connected to said lever between said opposed ends;

said first cam being on one side of said frame and said oscillator lever being on the other side of said frame, said first cam follower extending through said frame member for attachment to said lever and contacting engagement with said cam, whereby said transverse motion of said ink ribbon is sychronized to a particular postion of said reciprocating printing head and characters may be printed from either portion.

15. The printer of claim 14, wherein said first cam and follower produce motion transverse to said common turning axis and said second cam and follower produce motion parallel to said common turning axis.

16. The printer of claim 14, wherein said first cam is a disk having the cam profile recessed into one surface of said disk and the second cam profile is raised from said disk.

17. The printer of claim 16, wherein said second cam profile is raised from the opposite surface from said recess of said disk.

18. The printer of claim 17, wherein said frame is H-shaped and said frame member is the cross-bar between two side frame members.

19. The printer of claim 14, and further comprising means for advancement of said ink ribbon in a direction parallel to the reciprocating motion of said printing head.

20. The printer of claim 19, wherein said means for advancement of said ink ribbon includes said lever for reciprocating said print head, whereby advancement of said ink ribbon is synchronized to the reciprocating motion of said print head.

21. The printer of claims 1 or 14 wherein each portion of said ink ribbon includes a different color of ink.

22. The printer of claim 1 or claim 14 and further comprising means for detecting the position of said printing head, said detecting means including:

an electrical switch, said switch being mounted to said frame, said switch being electromagnetically actuated ON and OFF by the passing of a rotating permanent magnet, whereby electrical control of said printer is synchronized to the mechanical operation and position of said printer.

23. The printer of claim 22, and further including a detector sensing the rotation of said motor, said motor being geared in fixed ratio to said first cam, said sensor outputting periodic signals at a repetition rate far in excess of the reciprocating rate of said printing head, means for generating timing signals from said sensor output, whereby said timing signals are provided during the reciprocation of said printing head, said timing signals being uniformly spaced and synchronizing the printing on said paper by said printing head.

24. The printer of claim 23, wherein said printing head includes means for forming said characters by printing dots and said timing signals at least bisect the time required for said printing head to print one dot on said paper.

25. The printer of claim 23, wherein said detector comprises a circular rotor turning with the shaft of said motor, a plurality of magnetic poles uniformly spaced around the periphery of said rotor, and a yoke having a detecting coil therein, said detecting coil being arranged concentrically with said rotor, whereby rotation of said rotor induces timing signal voltages in said detecting coil, said voltages varying periodically at a rate in proportion to the number of said magnetic poles on said rotor.

26. The printer of claim 1 or claim 14, and further comprising biasing means for holding said follower against said first cam whereby said motion of said printing head is accurately controlled.

27. The printer of claim 26 wherein said biasing means is a spring.

28. The printer of claim 3 or 14 wherein said pivotable mounting of said lever to said frame is within the maximum distance of said first cam from said common axis, whereby a printer of reduced dimension is produced.

29. The printer of claim 1, or 14, wherein said printing head includes means for forming said characters by printing dots.

* * * * *